US009865912B2

(12) United States Patent
Bryant

(10) Patent No.: US 9,865,912 B2
(45) Date of Patent: Jan. 9, 2018

(54) UNIVERSAL CEILING ANTENNA MOUNT

(71) Applicant: Michael Eugene Bryant, Aurora, IL (US)

(72) Inventor: Michael Eugene Bryant, Aurora, IL (US)

( * ) Notice: Subject to any disclaimer, the term of this patent is extended or adjusted under 35 U.S.C. 154(b) by 0 days.

(21) Appl. No.: 15/460,606

(22) Filed: Mar. 16, 2017

(65) Prior Publication Data

US 2017/0187088 A1 Jun. 29, 2017

Related U.S. Application Data

(62) Division of application No. 14/180,330, filed on Feb. 13, 2014, now Pat. No. 9,634,375.

(60) Provisional application No. 61/763,991, filed on Feb. 13, 2013.

(51) Int. Cl.

| | |
|---|---|
| ***H01Q 1/42*** | (2006.01) |
| ***H01Q 1/52*** | (2006.01) |
| ***H01Q 1/22*** | (2006.01) |
| ***H01Q 1/00*** | (2006.01) |
| ***H01Q 1/12*** | (2006.01) |

(52) U.S. Cl.

CPC ..... *H01Q 1/1214* (2013.01); *H01Q 1/007* (2013.01); *H01Q 1/22* (2013.01); *H01Q 1/1221* (2013.01); *Y10T 29/49018* (2015.01)

(58) Field of Classification Search

CPC ..... H01Q 1/007; H01Q 1/1214; H01Q 1/22; H01Q 1/1207; H01Q 1/1221

USPC ..... 248/342, 343, 344, 200.1; 343/878, 872, 343/841, 767, 770; 439/140, 537, 313; 52/238.1

See application file for complete search history.

(56) References Cited

U.S. PATENT DOCUMENTS

| | | | | |
|---|---|---|---|---|
| 5,522,577 | A * | 6/1996 | Roesch | F04D 29/601 248/205.1 |
| 5,900,583 | A * | 5/1999 | Russo | H02G 3/20 174/61 |
| 7,486,251 | B2 * | 2/2009 | Chan | E04B 9/006 343/872 |
| 7,614,762 | B2 * | 11/2009 | Tseng | F21V 21/03 248/343 |
| 8,025,528 | B2 * | 9/2011 | Smith | B60R 25/00 439/140 |
| 8,998,164 | B2 * | 4/2015 | Marquardt | F16M 11/36 248/188.9 |
| 9,634,375 | B2 * | 4/2017 | Bryant | H01Q 1/007 |
| 2010/0328179 | A1 * | 12/2010 | Takisawa | H01Q 1/1207 343/841 |

(Continued)

*Primary Examiner* — Tan Le

(74) *Attorney, Agent, or Firm* — Dunlap Bennett & Ludwig PLLC

(57) ABSTRACT

A universal ceiling antenna mount may include a plate having a first side and a second side. The plate may include at least one antenna adapter hole, at least one mounting post attached to the second side of the plate, and at least one stem having a top open end and a bottom open end. The bottom open end of the stems may attach to the second side of the plate over the antenna adapter holes. A top plate having at least one hole and at least one mounting hole may sandwich a ceiling tile with the second side of the plate and be secured. At least one coaxial antenna cable may be connected to a top side of mount. At least one antenna may be connected to a bottom side of the mount.

12 Claims, 4 Drawing Sheets

(56) References Cited

U.S. PATENT DOCUMENTS

2014/0223726 A1* 8/2014 Bryant ..... H01Q 1/007
29/601

* cited by examiner

UNIVERSAL CEILING ANTENNA MOUNT

CROSS-REFERENCE TO RELATED APPLICATION

This application claims the benefit of U.S. patent application Ser. No. 14/180,330, filed Feb. 13, 2014, which claims the benefit of U.S. provisional application No. 61/763,991, filed Feb. 13, 2013, the contents of which are herein incorporated by reference.

BACKGROUND OF THE INVENTION

The present invention relates to antenna mounting and, more particularly, to a universal ceiling antenna mount. In commercial buildings with false or drop ceilings, installers of wireless devices must either locate the device and antennas above the ceiling tile, resulting in signal loss through the tile, or use dedicated signal purpose antennas, such as a single antenna often shaped similar to a smoke detector with a fixed frequency and other electrical characteristics. These fixed antennas are typically one antenna, often costly with no flexibility.

The primary two methods used currently in commercial drop tile ceilings is to either co-locate the antennas with the radio device above the ceiling or use fixed ceiling mounted antennas. In the event a new application for an antenna with a different frequency and radio frequency characteristics arises, a new expensive and fixed frequency-gain antenna must be installed. Costs dramatically increase when more than one antenna may be needed.

As can be seen, there is a need for a universal ceiling antenna mount that allows for multiple antennas of the same or different frequency and gain to be utilized on the mount providing flexibility and positioned to prevent signal loss.

SUMMARY OF THE INVENTION

In one aspect of the present invention, a universal ceiling antenna mount comprises: a plate having a first side and a second side, wherein the plate comprises: at least one antenna adapter hole; at least one stem having a top open end and a bottom open end, wherein the bottom open end of the at least one stem attaches to the second side of the plate over the at least one antenna adapter hole; at least one mounting post attached to the second side of the plate; and a top plate having at least one hole and at least one mounting hole, wherein the second side of the plate and the top plate sandwich a ceiling tile, wherein the top plate and the plate are secured in position by at least one securing component removably attached to the at least one mounting post on the plate extended through the at least one mounting hole of the top plate.

In another aspect of the present invention, a method of passing an antenna connection through a ceiling tile, comprising: providing a plate comprises: at least one antenna adapter hole; at least one stem having a top open end and a bottom open end, wherein the bottom open end of the at least one stem attaches to the second side of the plate over the at least one antenna adapter hole; at least one mounting post attached to the second side of the plate; and at least one pointed perforator removably attached to the at least one stem; pressing the plate against a lower surface of the ceiling tile so that the at least one pointed perforator penetrates the lower surface of the ceiling tile; providing a top plate comprising: at least one hole configured to receive the at least one stem of the plate; at least one mounting hole configured to receive the at least one mounting post of the plate; removing the at least one pointed perforator from the at least one stem; sandwiching the ceiling tile between the plate and the top plate; securing the bottom and top plates by removably attaching at least one securing component to the at least one mounting post on the plate; inserting at least one adapter into the at least one antenna adapter hole from the first side of the plate; connecting at least one coaxial antenna cable to a top side of the at least one adapter; and connecting at least one antenna to a bottom side of the at least one adapter.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a universal ceiling antenna mount that may include a plate having a first side and a second side. The plate may include at least one antenna adapter hole, at least one mounting post attached to the second side of the plate, and at least one stem having a top open end and a bottom open end. The bottom open end of the stems may attach to the second side of the plate over the antenna adapter holes. A top plate having at least one hole and at least one mounting hole may sandwich a ceiling tile with the second side of the plate and be secured.

At least one coaxial antenna cable may be connected to a top side of mount. At least one antenna may be connected to a bottom side of the mount.

The present invention may allow for multiple antennas to be positioned a top plate may be mounted on an upper surface of a ceiling tile, while a plate may be mounted to a lower surface of the ceiling tile. The plates may be secured with the ceiling tile in between. Coaxial adapters may be inserted through the plates. The present invention allows flexibility to remove and change antennas of different styles, frequencies, gain and other electrical characteristics as desired that may be mounted in one mount.

Figure 1:
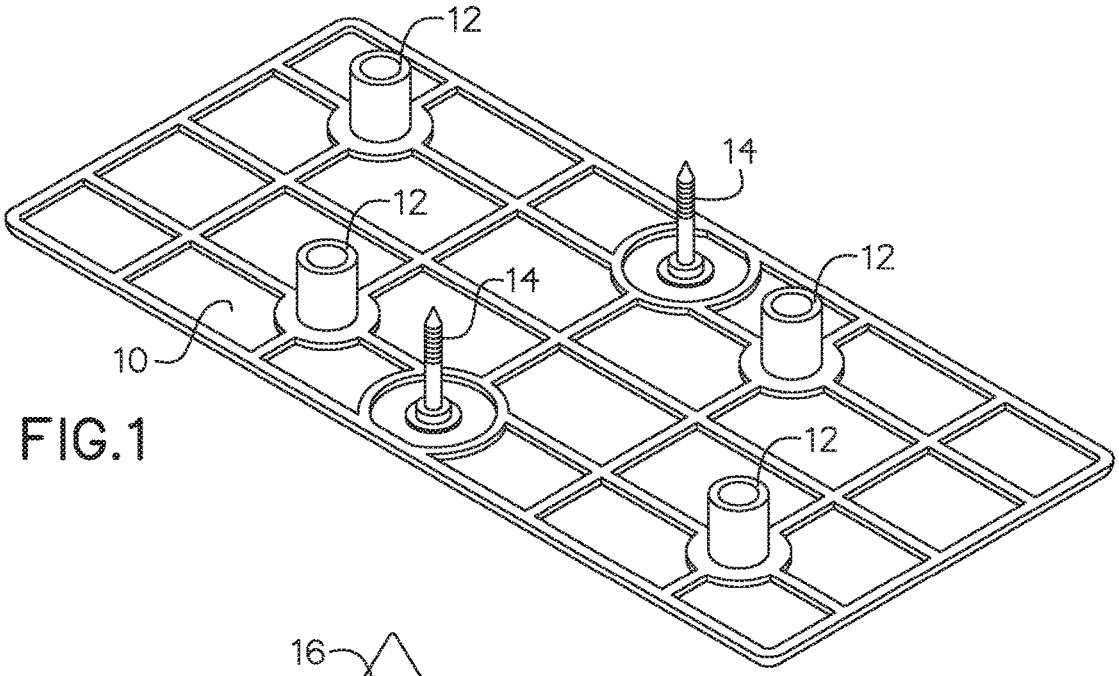
FIG. 1 is a perspective view of a plate of an exemplary embodiment of the present invention.
Figure 2:
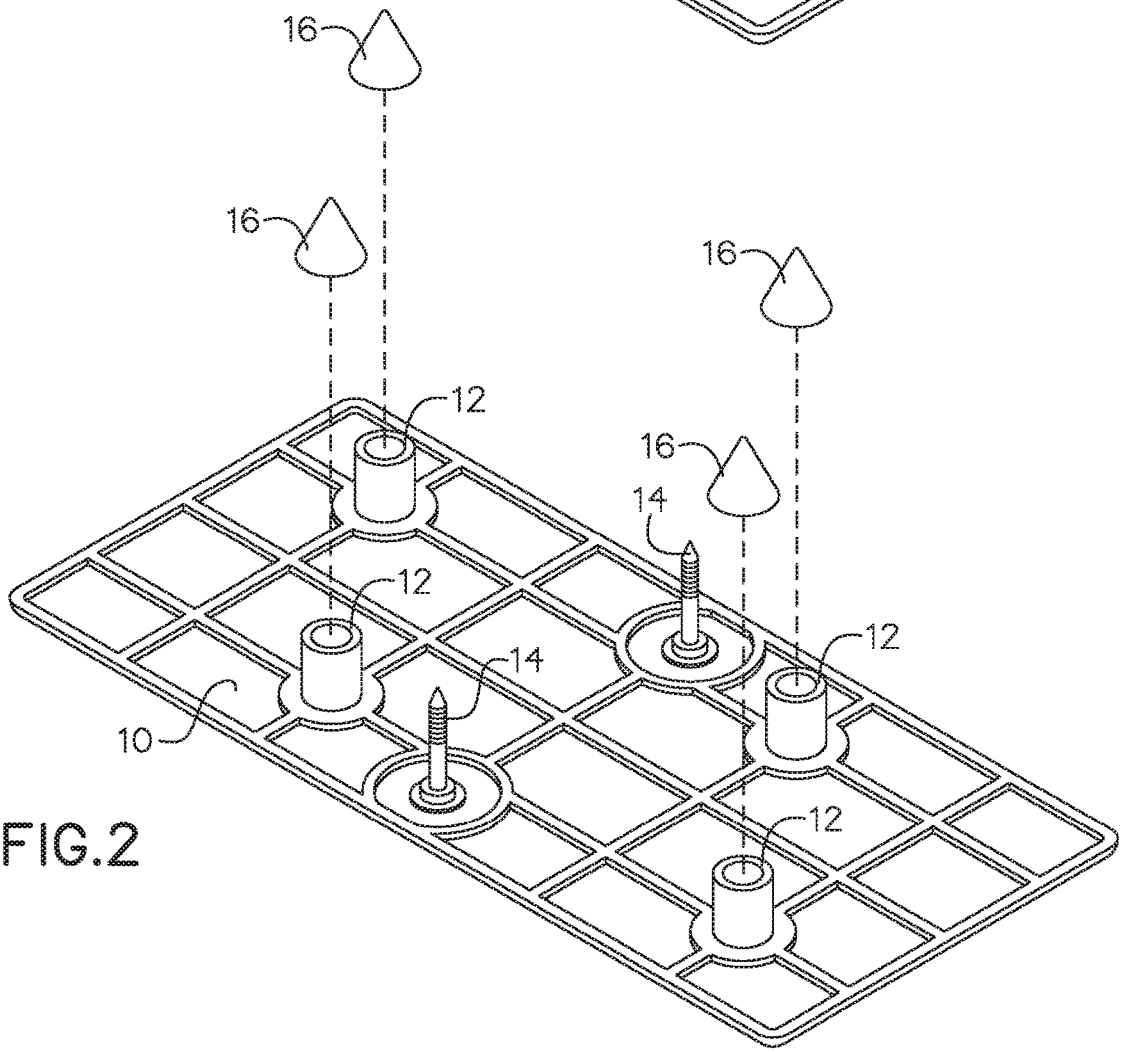
FIG. 2 is an exploded view demonstrating insertion of at least one stem onto the plate of an exemplary embodiment of the present invention.
Figure 3:
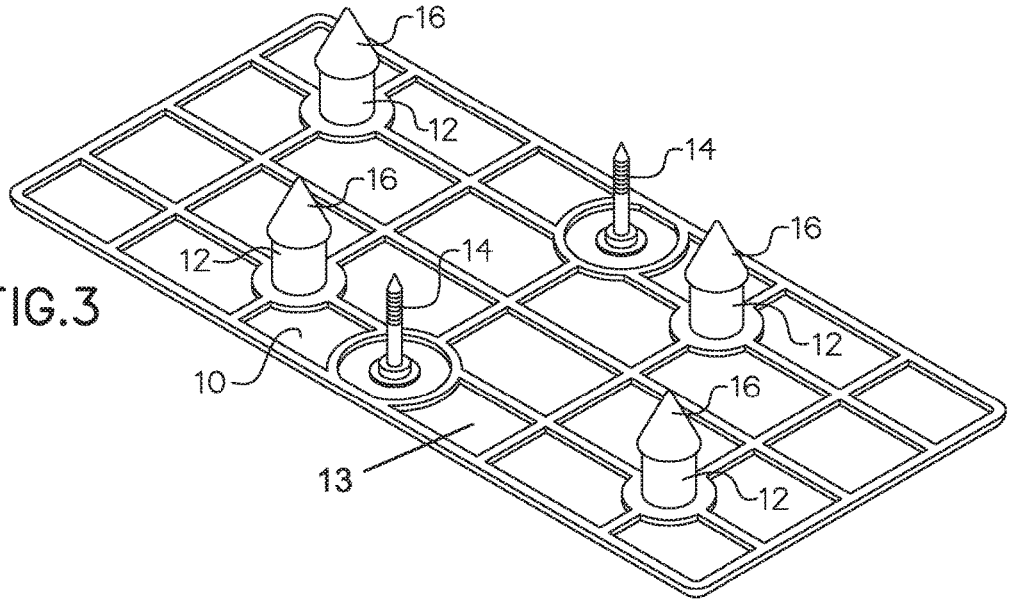
FIG. 3 is a perspective view demonstrating insertion of at least one stem onto the plate of an exemplary embodiment of the present invention.
Figure 4:
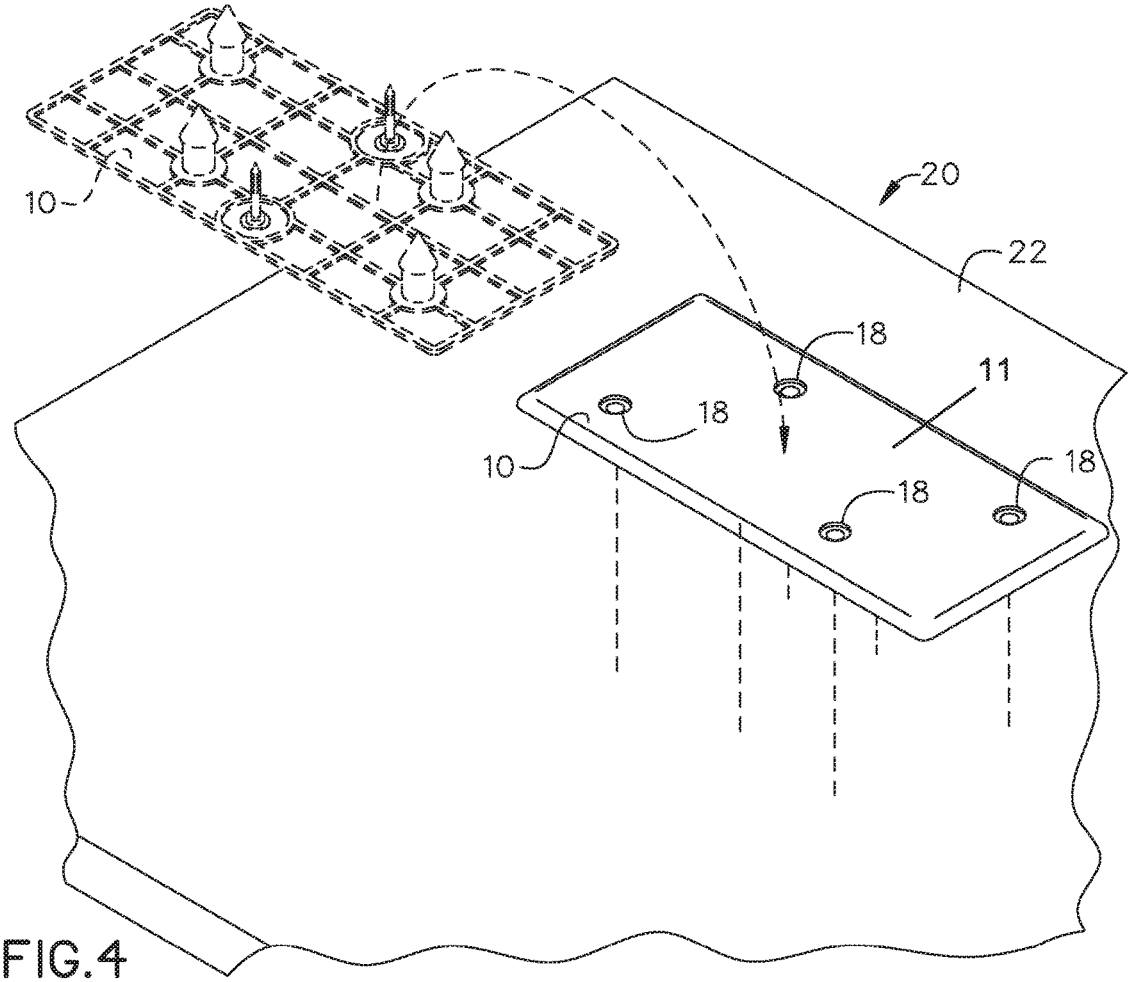
FIG. 4 is a perspective/exploded view demonstrating flipping of the plate and pressing against a ceiling tile for imprint of an exemplary embodiment of the present invention.
Figure 6:
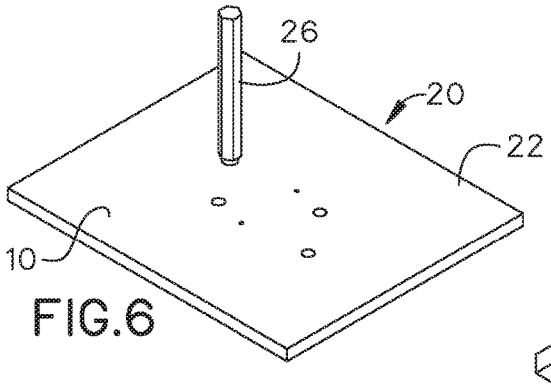
FIG. 6 is a perspective view of an exemplary embodiment of the present invention demonstrating use of the hand drill tool on the ceiling tile.
Figure 7:
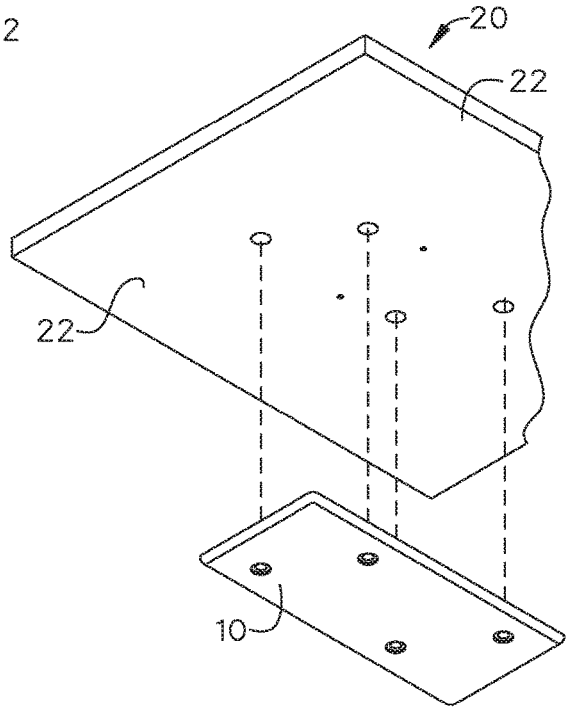
FIG. 7 is an exploded view of an exemplary embodiment of the present invention demonstrating insertion of the plate into the ceiling tile.
Figure 5:
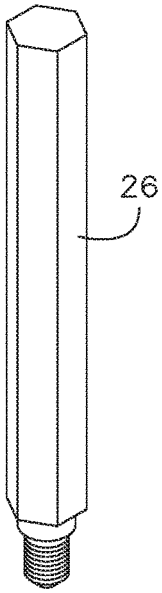
FIG. 5 is a perspective view of a hand tool drill of an exemplary embodiment of the present invention.
Figure 8:
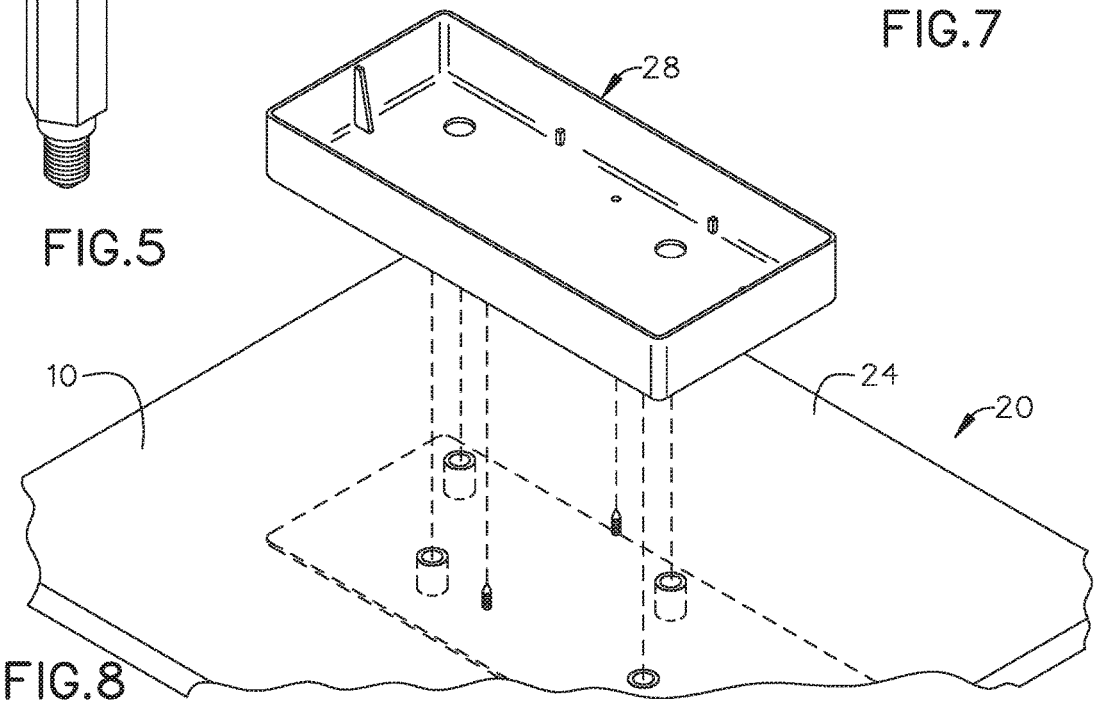
FIG. 8 is an exploded view of an exemplary embodiment of the present invention demonstrating insertion of a top plate.
Figure 9:
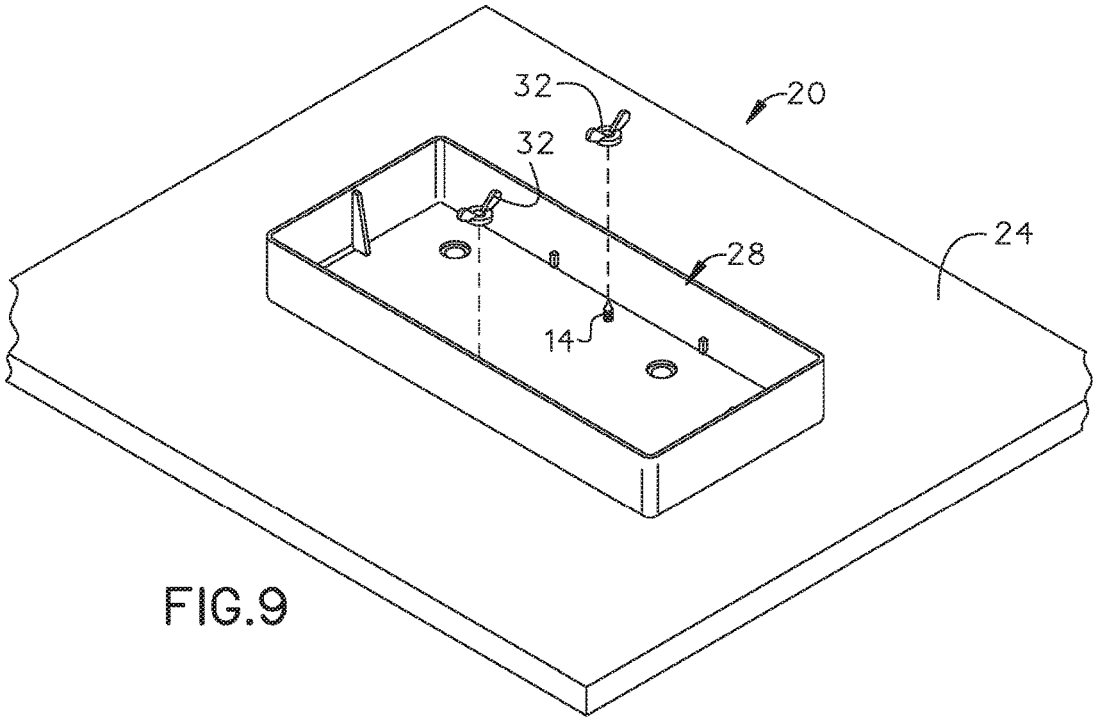
FIG. 9 is a perspective view of an exemplary embodiment of the present invention demonstrating securement of the top plate.
Figure 10:
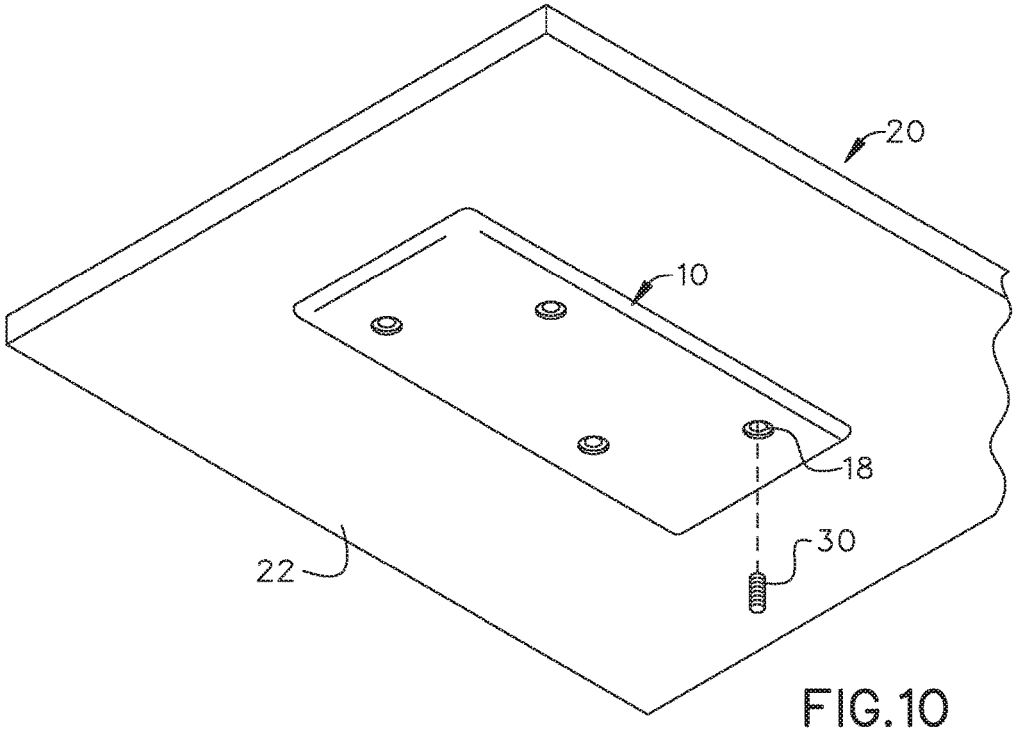
FIG. 10 is an exploded view of an exemplary embodiment of the present invention demonstrating insertion of at least one adapter into at least one antenna adapter hole.

As is illustrated in FIGS. 1 through 10, the present invention may include a plate 10 having a first side 11 and a second side 13. Along the plate 10 may be at least one antenna adapter hole 18. At least one stem 12 having an open end may be attached to the second side 13 of the plate 10 placed over the at least one antenna adapter hole 18. At least one central passage way may be accessed from the first side 11 of the plate 10 to the second side 13 of the plate 10 through the at least one antenna adapter hole 18 and the at least one stem 12.

At least one pointed perforator 16 may be removably attached to the open end of the at least one stem 12. In certain embodiments, the second side 13 of the plate 10 may have a raised surface. In certain embodiments, the at least one antenna adapter hole 18 may be four antenna adapter holes 18. In certain embodiments, the at least one stem 12 may be four stems 12. In certain embodiments, the at least one pointed perforator 16 may be four pointed perforators 16. At least one mounting post 14 may be attached to the second side 13 of the plate 10. In certain embodiments, the at least one mounting post 14 may be two mounting posts on either end of the second side 13 of the plate 10.

In certain embodiments, the at least one pointed perforator 16 may be pressed into a lower surface 22 of a ceiling tile 20 so that the at least one pointed perforator 16 may pass through the lower surface 22 of the ceiling tile 20. In certain embodiments, a hand drill tool 26 may be used to fully create the at least one hole through the ceiling tile 20. Once the at least one hole has been made, the at least one pointed perforator 16 may be removed from the plate 10. The second side 13 of the plate 10 may be placed against the lower surface 22 of the ceiling tile 20 with the at least one hole on the ceiling tile 20 and the at least one stem 12 aligned. A top plate 28, having at least one hole and at least one mounting hole, may be placed over the upper surface 24 of the ceiling tile 20 with the at least one hole of the ceiling tile 20 aligning with the at least one hole of the top plate 28.

The at least one stem 12 and at least one hole of the top plate 28 may align with the ceiling tile 20 sandwiched between. At least one securing component 32 may be removably attached to the at least one mounting post 14 on the plate 10 that extends through the ceiling tile 20, thereby securing the plate 10 and the top plate 28 to the ceiling tile 20. In certain embodiments, the at least one securing component 32 may be at least one wingnut. At least one adapter 30 may be inserted into the at least one antenna adapter hole 18 from the first side 11 of the plate 10. In certain embodiments, the at least one adapter 30 may be a reverse polarity subminiature version A (SMA) coaxial adapter.

A method of using the present invention may include the following. At least one coaxial antenna cable may be connected to a top side of the at least one adapter 30. The at least one coaxial antenna cable may be then connected to a radio device being used, such as a Wi-Fi access point, cellular repeater or the like. At least one antenna may be connected to a bottom side of the at least one adapter 30. The at least one antenna may be white to blend in with the surrounding ceiling tiles. Each antenna may be a different style, frequency, gain or other electrical characteristic providing both low cost and full flexibility with the ability to screw in at least one differing or same antenna in each plate 10.

In certain embodiments, the antenna may be a dipole antenna of various frequencies and gain values. In certain embodiments, the antenna may be a rubber duck style antenna of various frequencies and gain values. The number of the at least one adapter 30 and associated components may vary and may depend on the preference of the user.

It should be understood, of course, that the foregoing relates to exemplary embodiments of the invention and that modifications may be made without departing from the spirit and scope of the invention as set forth in the following claims.

What is claimed is:

1. A method of passing an antenna connection through a ceiling tile, comprising:

providing a plate comprising:

at least one antenna adapter hole;

at least one stem having a top open end and a bottom open end, wherein the bottom open end of the at least one stem attaches to a second side of the plate over the at least one antenna adapter hole;

at least one mounting post attached to the second side of the plate; and at least one pointed perforator removably attached to the at least one stem;

pressing the plate against a lower surface of the ceiling tile so that the at least one pointed perforator penetrates the lower surface of the ceiling tile;

providing a top plate comprising:

at least one hole configured to receive the at least one stem of the plate;

at least one mounting hole configured to receive the at least one mounting post of the plate;

removing the at least one pointed perforator from the at least one stem; and sandwiching the ceiling tile between the plate and the top plate, wherein the at least one antenna adapter hole and the at least one stem are configured to carry an antenna adapter through the ceiling tile.

2. The method of claim 1, further comprising:

securing the bottom and top plates by removably attaching at least one securing component to the at least one mounting post on the plate.

3. The method of claim 1, further comprising:

inserting at least one adapter into the at least one antenna adapter hole from the first side of the plate.

4. The method of claim 3, further comprising:

connecting at least one coaxial antenna cable to a top side of the at least one adapter.

5. The method of claim 4, further comprising:

connecting at least one antenna to a bottom side of the at least one adapter.

6. The method of claim 1, further comprising the step of:

inserting a hand drill tool through the at least one penetration of the ceiling tile, fully opening up at least one hole in the ceiling tile for at least one central passage way.

7. A method of passing an antenna connection through a ceiling tile, comprising:

providing a plate comprising:

a first side and a second side, an antenna adapter hole;

an adapter configured to be received in the antenna adapter hole through the first side of the plate;

a stem having a top open end and a bottom open end, wherein the bottom open end of the stem attaches to the second side of the plate over the antenna adapter hole;

a mounting post attached to the second side of the plate; and providing a top plate having comprising:

a first side and a second side a hole and a mounting hole, sandwiching a ceiling tile between the second side of the plate and the top plate wherein the stem and the hole of the top plate are configured to carry the adapter through the ceiling tile.

8. The method of claim 7, further comprising:

securing the top plate and the plate by a securing component removably attached to the mounting post on the plate and extended through the mounting hole of the top plate.

9. The method of claim 8, further comprising:

providing a pointed perforator that is removably attached to the stem.

10. The method of claim 7, further comprising:

inserting at least one adapter into the at least one antenna adapter hole from the first side of the plate.

11. The method of claim 10, further comprising:

connecting at least one coaxial antenna cable to a top side of the at least one adapter.

12. The method of claim 11, further comprising:

connecting at least one antenna to a bottom side of the at least one adapter.

* * * * *